US006874410B1

(12) United States Patent
Huang

(10) Patent No.: US 6,874,410 B1
(45) Date of Patent: Apr. 5, 2005

(54) PRESSING MECHANISM FOR PAPER CUTTING DEVICE

(76) Inventor: Chien Kai Huang, No. 136, Tsu Chiang Road, Chang Hua City (TW)

( * ) Notice: Subject to any disclaimer, the term of this patent is extended or adjusted under 35 U.S.C. 154(b) by 0 days.

(21) Appl. No.: 10/780,744

(22) Filed: Feb. 19, 2004

(51) Int. Cl.[7] ..... B30B 9/00

(52) U.S. Cl. ..... 100/8; 83/464; 83/467.1; 83/468.2

(58) Field of Search ..... 83/375, 377, 453, 83/464, 466, 468.1, 468.2, 468.7, 374, 381, 451, 452, 467.1, 465; 269/60, 61, 225, 227, 111; 100/289, 8, 10, 11, 16, 214; 74/89.18

(56) References Cited

U.S. PATENT DOCUMENTS 819,615 A * 5/1906 Stirling ..... 83/468.8
1,112,326 A * 9/1914 Roper ..... 83/409
1,186,287 A * 6/1916 Cromwell ..... 83/425.2
1,230,227 A * 6/1917 Salter ..... 99/636
3,580,123 A * 5/1971 Westra et al. ..... 83/380
3,987,694 A * 10/1976 Kaufman ..... 83/453
4,161,900 A * 7/1979 Mendelsohn ..... 83/409
4,455,904 A * 6/1984 Havner et al. ..... 83/375

* cited by examiner

*Primary Examiner*—Kenneth E. Peterson
*Assistant Examiner*—Omar Flores Sánchez
(74) *Attorney, Agent, or Firm*—Bacon & Thomas PLLC

(57) ABSTRACT

A pressing mechanism for a paper cutting device includes a frame with a U-shaped bracket connected thereto and a threaded rod extends through two extensions of the bracket. A wheel is connected to a top end of the threaded rod. A sleeve is threadedly mounted to the threaded rod and includes two rack portions. Two link assemblies each have a first plate and a second plate which is connected to one of two ends of the first plate. The other end of each of the first plates has teeth which are engaged with the rack portions of the sleeve. The two first plates are pivotably connected to the frame and the two second plates are pivotably connected to a pressing member. The sleeve is movable along the threaded rod by rotating the threaded rod and the two first plates are driven to pivot so as to move the pressing member up and down.

3 Claims, 6 Drawing Sheets

PRESSING MECHANISM FOR PAPER CUTTING DEVICE

FIELD OF THE INVENTION

The present invention relates to a pressing mechanism for a paper cutting device and the mechanism is easily to assemble and reliable for long-term of use.

BACKGROUND OF THE INVENTION

A conventional pressing mechanism for paper cutting device is disclosed in FIGS. 1 and 2 and generally includes a frame 11 including a first board 112 with two second boards 111 connected to two ends of a front side of the first board 112. A U-shaped bracket 12 has two extensions on two ends thereof and a threaded rod 13 extends trough the two extensions and a wheel 14 is connected to a top end of the threaded rod 13. Two circular plates 114 are connected to two rods on the two second boards 111. Two toothed member 153 each have teeth 1531 defined in a curve side thereof and are respectively connected to two link assemblies 15. Each link assembly 15 includes a first piece 151 and a second piece 16, the first piece 15 has a hole 152 so as to pivotably mount to the two rods and the second piece 16 has a pin which is pivotably connected an end of a pressing member 17. Each toothed member 153 has a connection portion 1532 which has a groove 1533 in which the respective one of the two circular plates 114 is engaged. The pressing member 17 can be lowered or raised by rotating the wheel 14 and the two toothed members 153 are then pivotable about the two rods by the rotation of the threaded rod 13 to drive the teeth 1531 on the toothed members 153. The teeth 1531 are directly engaged with the threaded rod 13 and driven by the threaded rod 13 so that there is a serious wear-out problem for the teeth 1531 and the threaded rod 13.

The present invention intends to provide a pressing mechanism that has a simpler structure and is reliable for long-term of use.

SUMMARY OF THE INVENTION

In accordance with one aspect of the present invention, there is provided a pressing mechanism for a paper cutting device and the mechanism comprises a frame having a U-shaped bracket connected thereto. The U-shaped bracket has two extensions on two ends thereof and a threaded rod extends through the two extensions. A wheel is connected to a top end of the threaded rod. A sleeve is threadedly mounted to the treaded rod and located between the two extensions of the U-shaped bracket. The sleeve has two rack portions.

Two link assemblies each have a first plate and a second plate which is connected to one of two ends of the first plate. The other end of each of the first plates has teeth which are engaged with the rack portions of the sleeve. The two first plates are pivotably connected to the board and the two second plates are pivotably connected to a pressing member.

The pressing member is up and down by rotating the wheel of the threaded rod.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
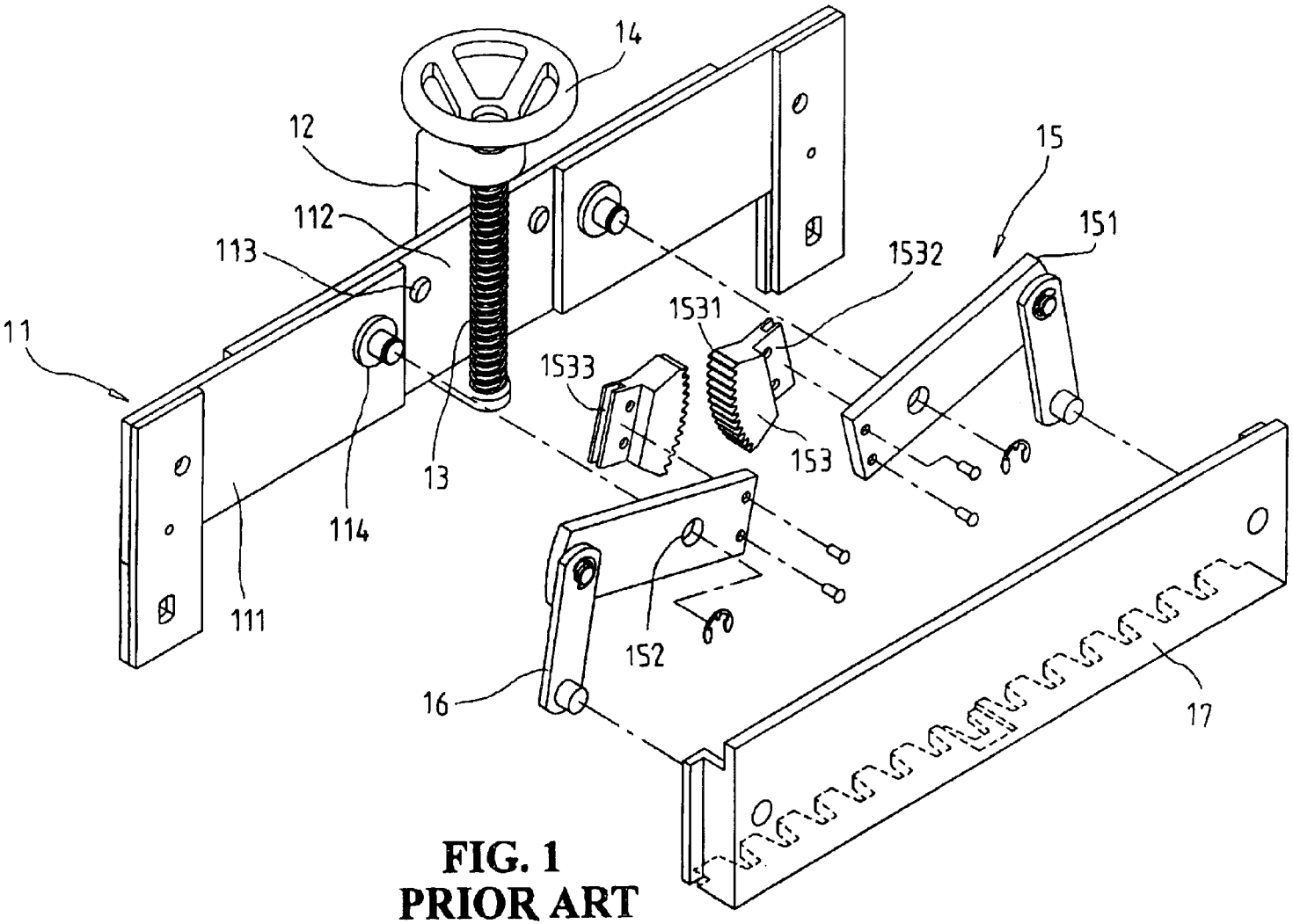
FIG. 1 PRIOR ART
FIG. 1 is an exploded view to show a conventional pressing mechanism of a paper cutting device.
Figure 2:
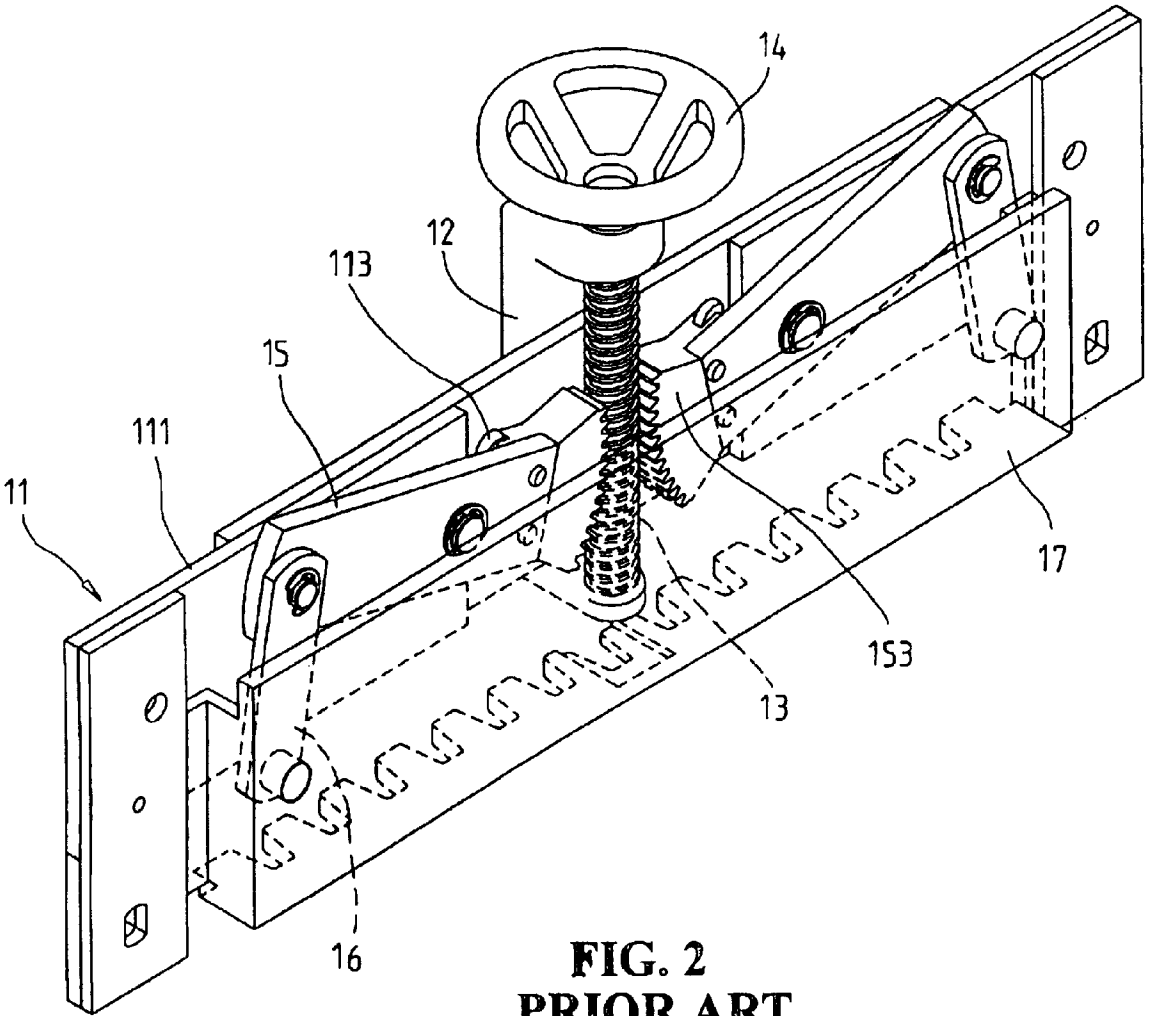
FIG. 2 PRIOR ART
FIG. 2 is a perspective view to show the conventional pressing mechanism of a paper cutting device.
Figure 3:
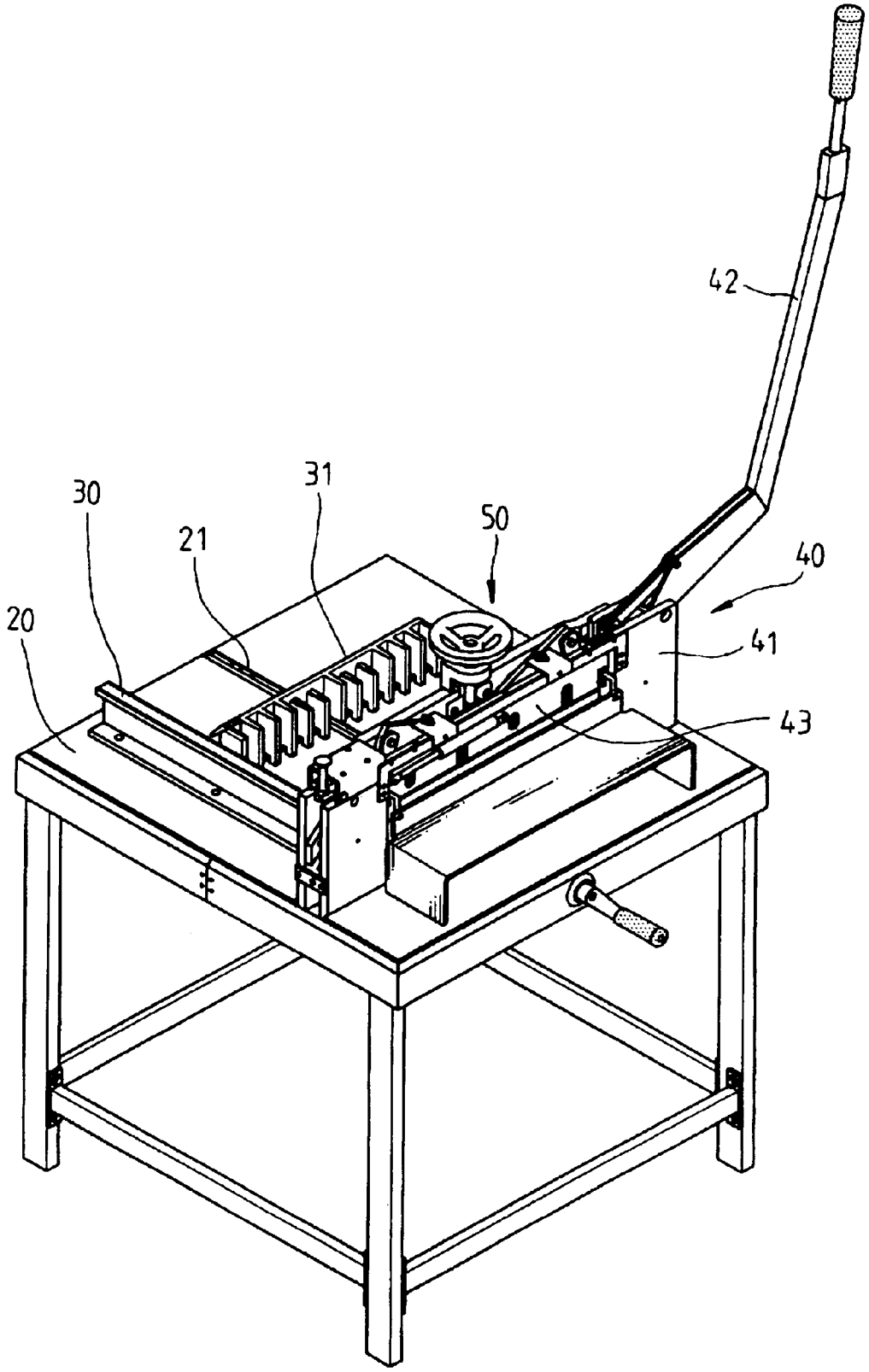
FIG. 3 is a perspective view to show the pressing mechanism of the present invention is connected to a paper cutting device.
Figure 4:
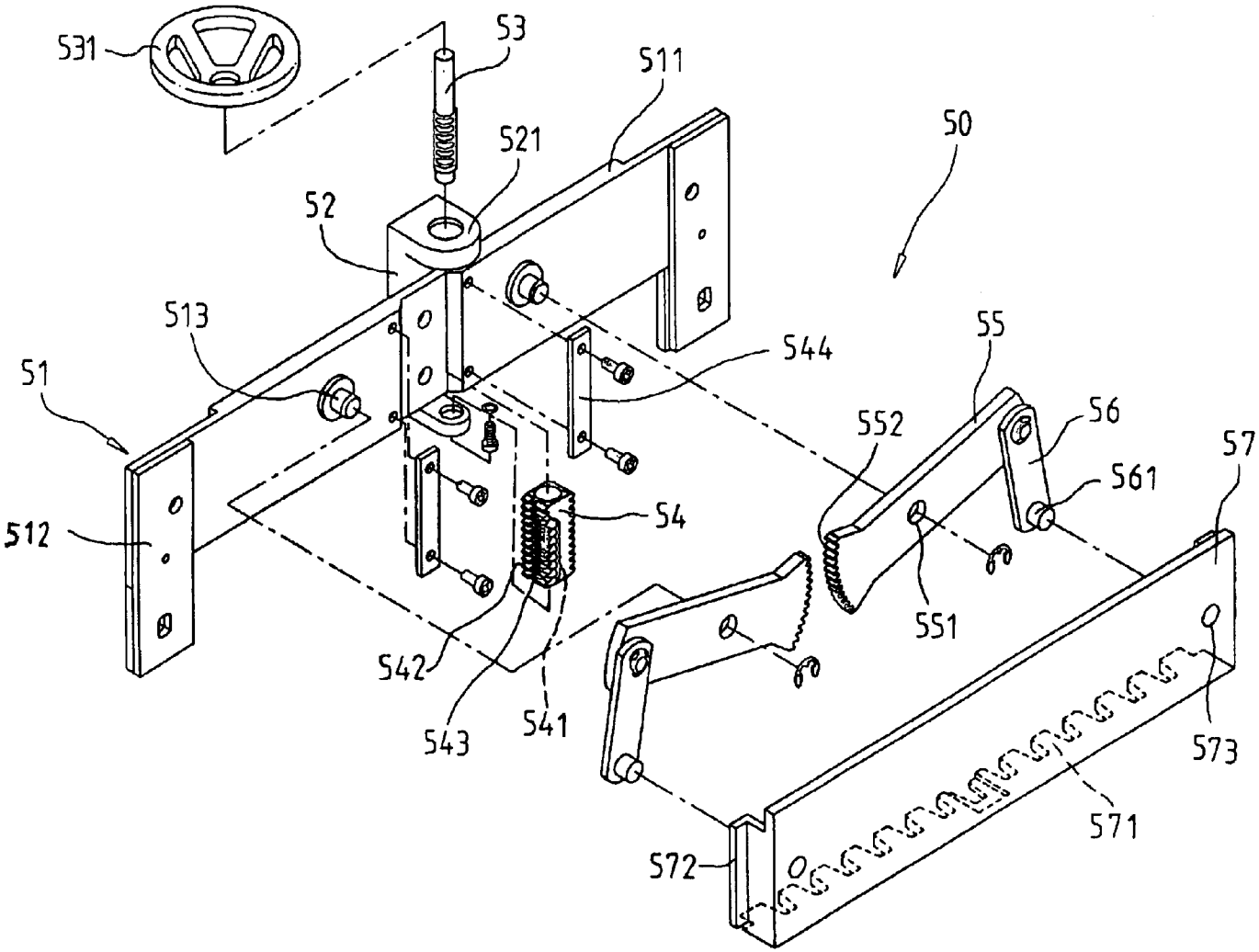
FIG. 4 is an exploded view to show the pressing mechanism of the present invention.
Figure 5:
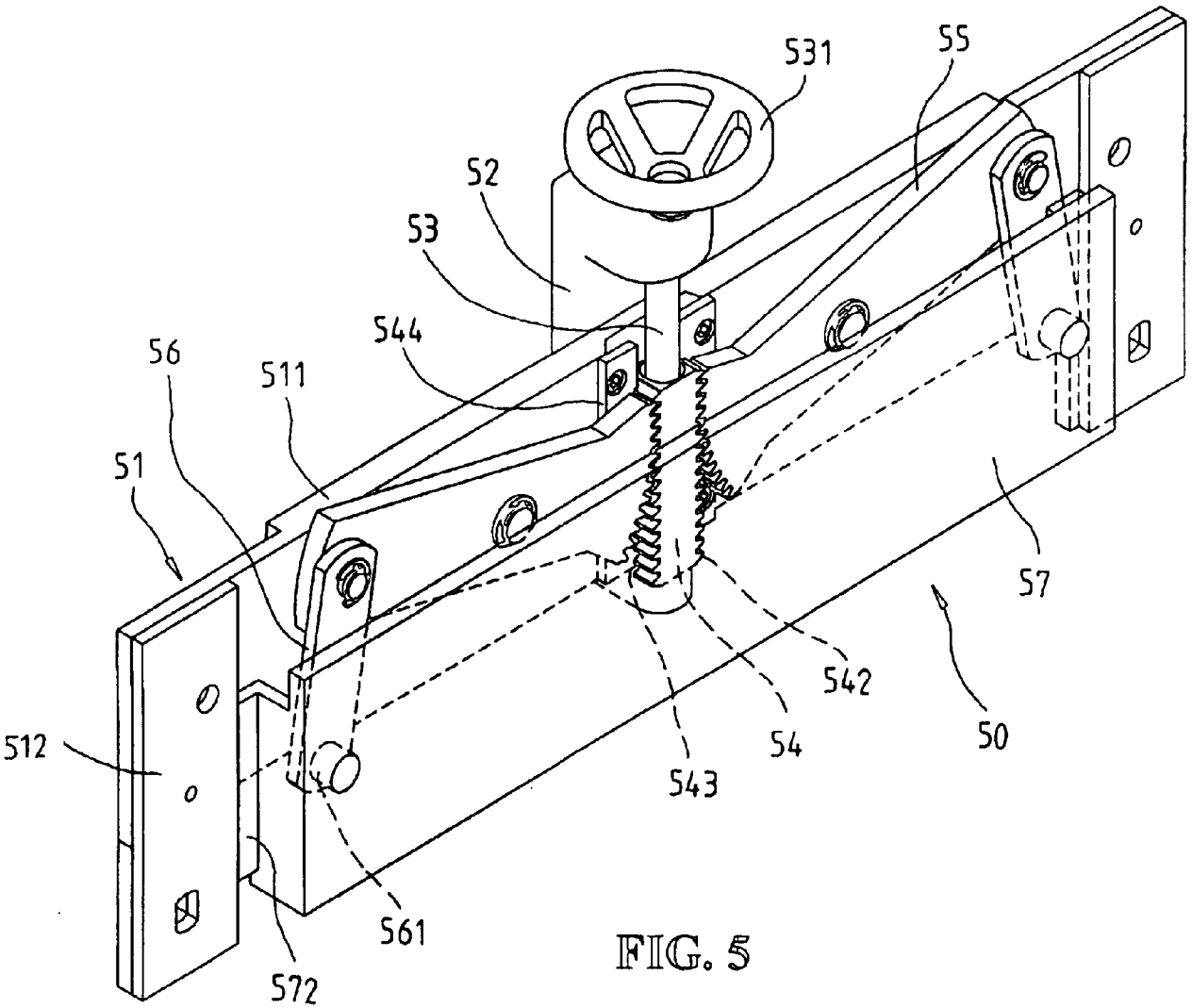
FIG. 5 is a perspective view to show the pressing mechanism of the present invention.

Referring to FIG. 3, the paper pressing mechanism 50 of the present invention comprises is connected with a paper cutting device 40 and both of which are put on a bench 20. The paper cutting device 40 includes a base 41 and a cutting blade 43 is pivotably connected to the base 41. An arm 42 is pivotably connected to the base 41 and operates the blade 43. Two guide fences 30 and 31 are respectively installed on the bench 20 in two directions so as to guide the paper during operation. A guide groove 21 is defined in a top of the bench 20 so that the paper cutting device 40 can be moved along the guide groove 21 when needed.

Referring to FIGS. 3 to 6, the paper pressing mechanism 50 comprises a frame 51 having a board 511 and a U-shaped bracket 52 is connected to the board 511. The U-shaped bracket 52 has two extensions 521 on two ends thereof and the board 511 is located between the two extensions 521. A threaded rod 53 extends through the two extensions 521 and a wheel 531 is connected to a top end of the threaded rod 53. Two pins 513 extend from a side of the board 511. Two end plates 512 are connected to two ends of the board 511 and two guide plates 544 are connected to the board 511.

A sleeve 54 has a threaded passage 541 so that the sleeve 54 is threadedly mounted to the threaded rod 53 by engaging the threaded passage 541 with the threaded rod 53. The sleeve 54 is located between the two extensions 521 of the U-shaped bracket 52. The sleeve 54 has two rack portions 543.

Figure 6:
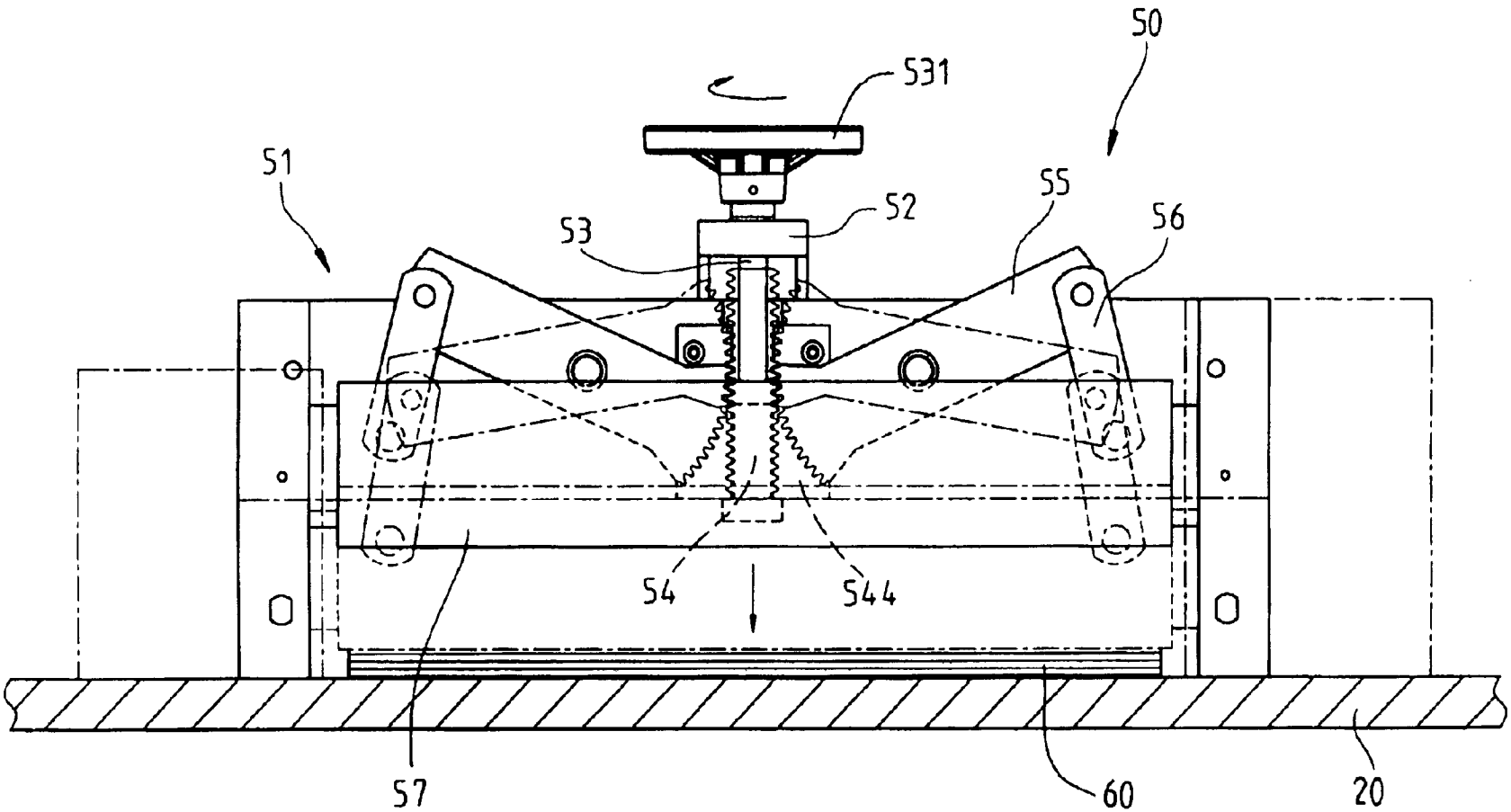
FIG. 6 shows the pressing member is moved up and down by rotating the wheel on the threaded rod.

Two link assemblies each have a first plate 55 and a second plate 56 which is connected to one of two ends of the first plate 55. The other end of each of the first plates 55 has teeth 552. The two first plates 55 are pivotably connected to the board 511 by inserting the two pins 513 in two holes 551 in the two first plates 55. The two second plates 56 each have a pin 561 which is pivotably inserted in holes 573 in a pressing member 57. The pressing member 57 includes serrated edge 571 and two guide flanges 572 are located on two ends thereof. The two flanges 572 of the pressing member 57 are movable along sides of the end plates 512. The two second plates 56 are engaged with the rack portions 543 by the teeth 552 on the second plates 56. The sleeve 54 includes two grooves 542 and the guide plates 544 engaged with the grooves 542 so that the sleeve 54 is moved up and down by rotating the wheel 531. As shown in FIG. 6, a pile of paper is put on the bench 20 and pressed by the pressing member 57 and the guide plates 544 ensure the movement of the sleeve 54 to be stable.

The pressing mechanism 50 includes less number of parts compared with the conventional mechanism and the can be used for a longer period of time.

While we have shown and described the embodiment in accordance with the present invention, it should be clear to those skilled in the art that further embodiments may be made without departing from the scope of the present invention.

What is claimed is:

1. A pressing mechanism comprising:

a frame having a board and a U-shaped bracket connected to the board, the U-shaped bracket having two extensions on two ends thereof and a threaded rod extending through the two extensions, a wheel connected to a top end of the threaded rod;

two link assemblies each having a first plate and a second plate which is connected to one of two ends of the first plate, the other end of each of the first plates having teeth, the two first plates pivotably connected to the board and the two second plates pivotably connected to a pressing member, and a sleeve threadedly mounted to the threaded rod and located between the two extensions of the U-shaped bracket, the sleeve having two rack portions and the two second plates engaged with the rack portions by the teeth on the first plates.

2. The mechanism as claimed in claim 1, wherein the sleeve includes two grooves and two guide plates are connected to the board, the guide plates engaged with the grooves.

3. The mechanism as claimed in claim 1, wherein the pressing member has two guide flanges on two ends thereof and two end plates are connected to two ends of the frame, the two flanges of the pressing member being movable along sides of the end plates.

* * * * *